United States Patent [19]

Lang

[11] Patent Number: 4,621,740

[45] Date of Patent: Nov. 11, 1986

[54] MULTI-STORY TOWER FOR GOODS DISPLAY

[75] Inventor: Franz J. Lang, Kelkheim, Fed. Rep. of Germany

[73] Assignee: Display-Design GmbH für moderne Verkaufsförderungsmittel und Raumausstattung

[21] Appl. No.: 698,630

[22] Filed: Feb. 6, 1985

[30] Foreign Application Priority Data

Feb. 7, 1984 [DE] Fed. Rep. of Germany ... 8403538[U]

[51] Int. Cl.[4] ..... A47F 5/00

[52] U.S. Cl. ..... 211/133; 211/194

[58] Field of Search ..... 211/194, 188, 133

[56] References Cited

U.S. PATENT DOCUMENTS

| | | | |
|---|---|---|---|
| 3,964,810 | 6/1976 | Murphy | 211/188 X |
| 4,428,487 | 1/1984 | Hepp | 211/188 X |
| 4,467,927 | 8/1984 | Nathan | 211/188 X |

FOREIGN PATENT DOCUMENTS

| | | | |
|---|---|---|---|
| 23078 | of 1914 | United Kingdom | 211/188 |
| 0101647 | 9/1916 | United Kingdom . | |
| 727435 | 3/1955 | United Kingdom . | |
| 765786 | 1/1957 | United Kingdom . | |
| 782855 | 9/1957 | United Kingdom . | |
| 1576215 | 10/1980 | United Kingdom . | |
| 2089202 | 6/1982 | United Kingdom . | |

*Primary Examiner*—Robert W. Gibson, Jr.

*Attorney, Agent, or Firm*—Toren, McGeady, Stanger, Goldberg & Kiel

[57] ABSTRACT

In a multi-story tower for goods display with rectangular platforms and spacer supports extending between successive platforms, the reception sockets for the spacer supports are arranged in the region of the short side of the rectangle of the platform outline and offset away from the corners in the direction towards the middle of the short side of the rectangle, so that the observer looking in the direction of the long side of the rectangle can better recognize and gain access to the goods.

12 Claims, 14 Drawing Figures

MULTI-STORY TOWER FOR GOODS DISPLAY

Figure 1:
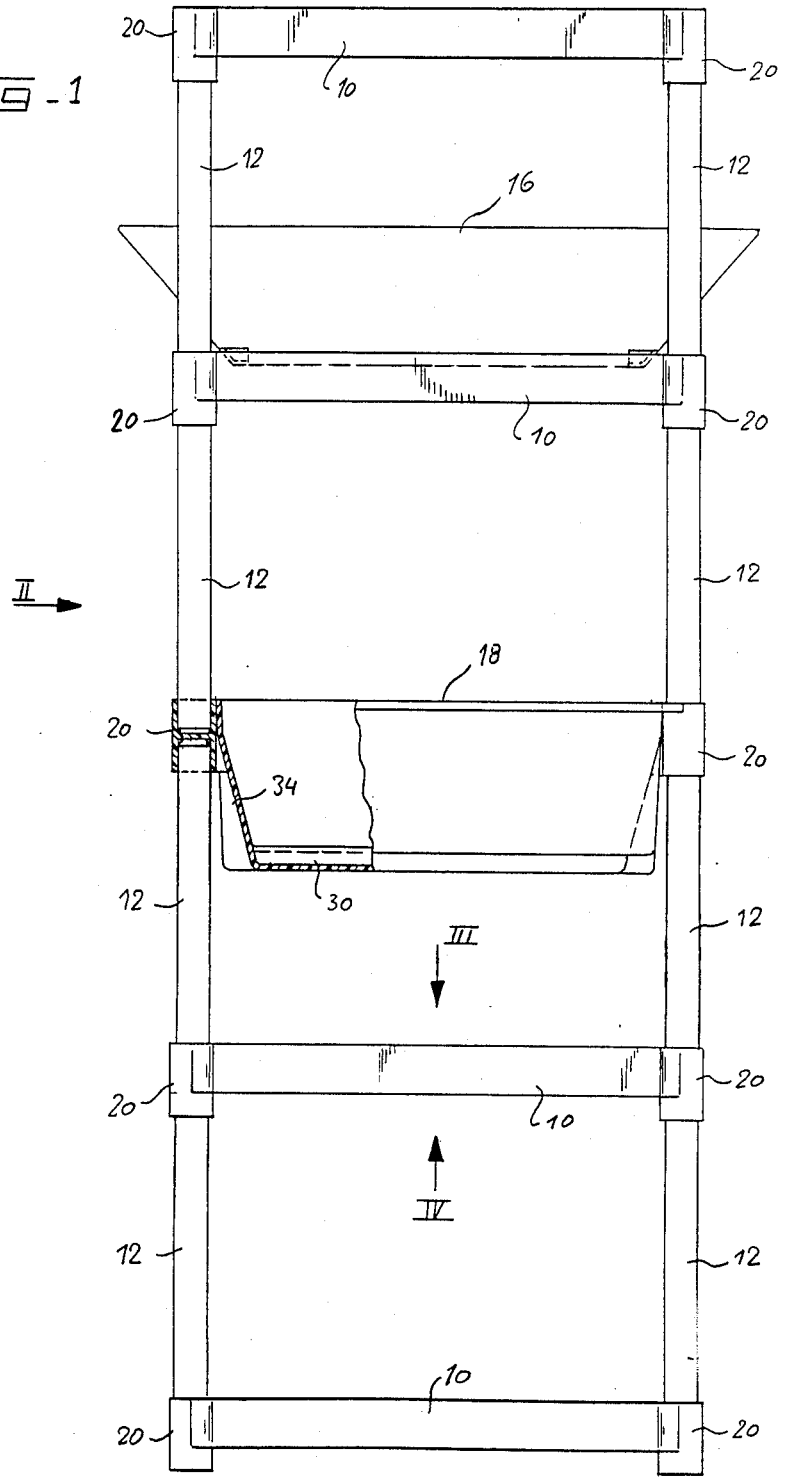

The invention relates to a multi-story tower for goods display comprising a plurality of carrier elements vertically spaced from one another and a plurality of spacer supports each of which connects two successive carrier elements with one another.

Such a multi-story tower is known. In the known multi-story tower the spacer supports are attached to the corners of the carrier elements.

The invention is based upon the problem of developing a multi-story tower of this classification so that the inspection and withdrawal of the goods carried by the carrier elements are facilitated.

To solve this problem at least one of the carrier elements is formed with substantially rectangular outline and in that reception sockets for the reception of the spacer supports are arranged in the region of the short side of the rectangle at a distance from the neighboring corner in each case.

The reception sockets aims at an optimum compromise between stability for the one part and facility of inspection and access for the other.

Further, the reception sockets afford the preparation of the cheapest possible spacer supports.

The position of the reception sockets aims at preventing the sockets from occupying a part of the outline of the carrier elements.

The use of circular tubular reception sockets aims at simple, cheap and contact-compatible spacer supports.

When the carrier elements is formed as a platform the reception sockets can be at their lower ends, if desired, as stand feet.

The arrangement of an uppermost platform, makes access possbile from all sides to the goods stored thereon.

The use of stiffening ribs guarantees a high stability of the platforms and the reception sockets connected with them, with low consumption of material.

By providing an attachment on a carrier element formed as a platform, it is possible to receive loose bulk goods equally well with the use of ordinary platforms, with the cheapest means.

A folded cardboard cut-out shape lessens the cost of the bulk goods attachment.

Arrangement of the side walls facilitates access to the goods within the bulk goods attachment and ensuring that the goods on the platform assume an approximately statistic distribution by downward slipping.

The formation of the bottom flaps of the bulk goods attachment assures a stable cohesion between the attachment and platform, with simple and cheap means.

The construction of the bulk goods attachment aims at the possibility of minimum space requirements for the attachment, also the platforms and spacer supports, for transport and storage.

Forming the bulk goods attachment of two cardboard cut-out shapes permits a cheap and simple arrangement with the minimum of connection parts.

One of the carrier elements can be formed as a trough in which loose bulk goods are to be displayed to a great extent and regularly.

The carrier elements as loose bulk goods troughs afford individual stacking

The accompanying Figures explain the invention by reference to an example of embodiment.

Figure 2:
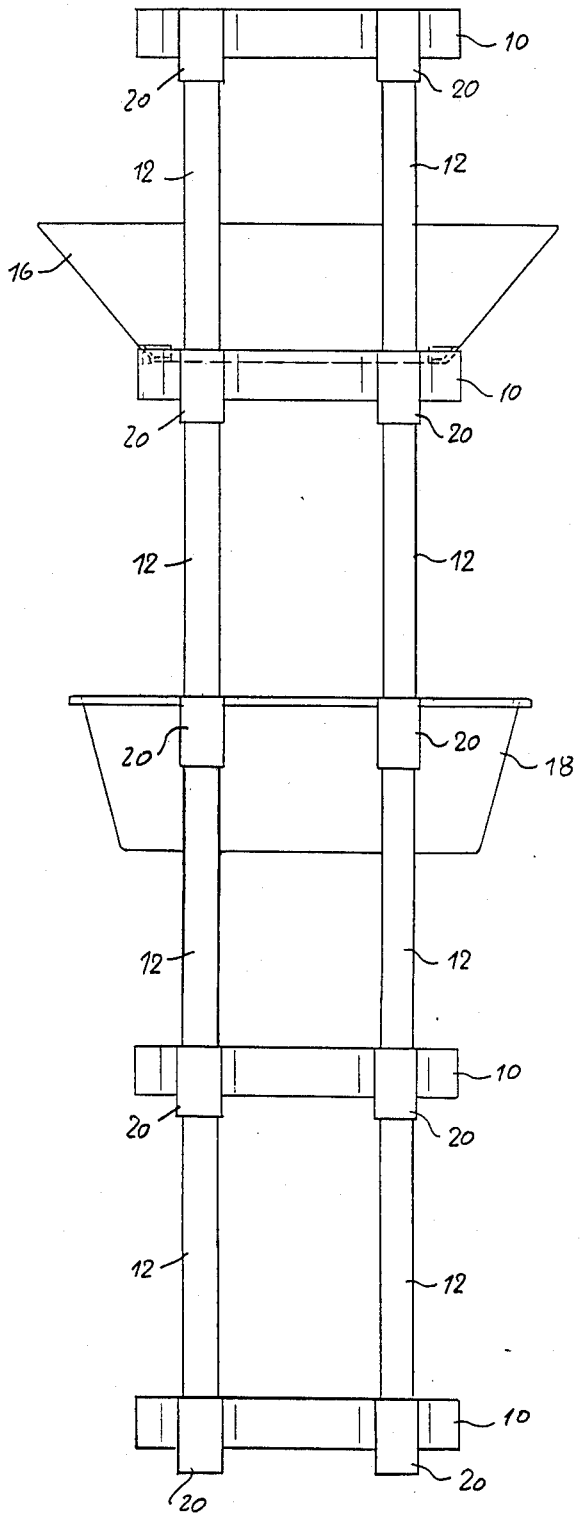
Figure 3:
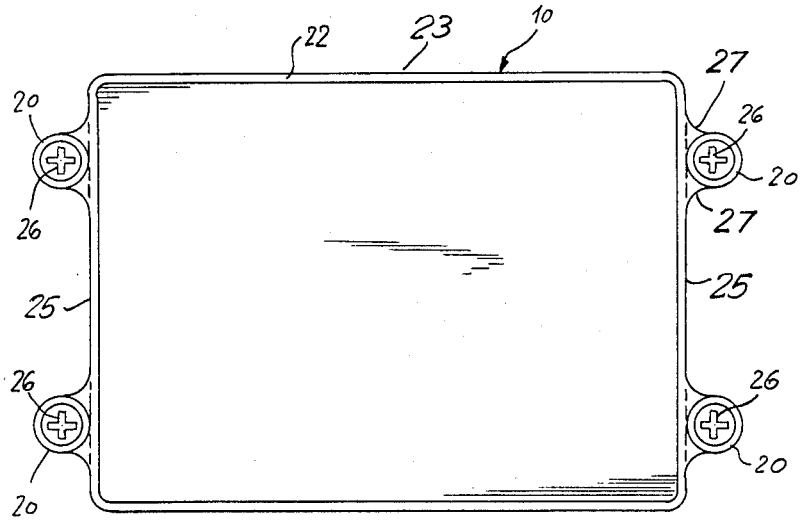
Figure 4:
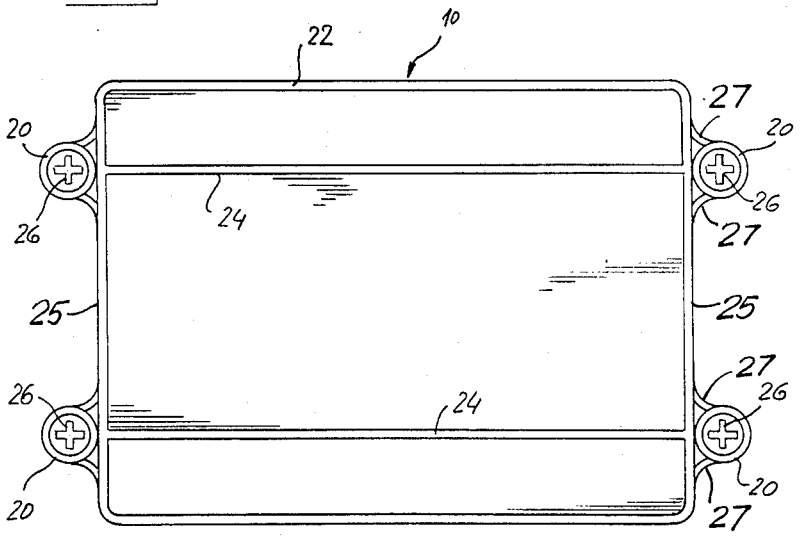
Figure 5:
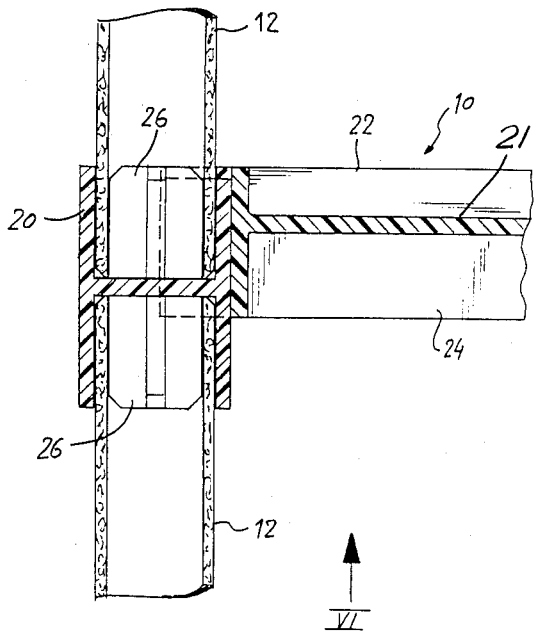
Figure 6:
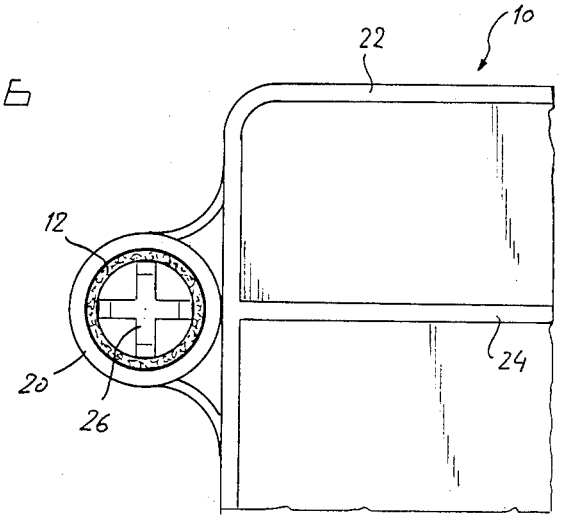
Figure 7:
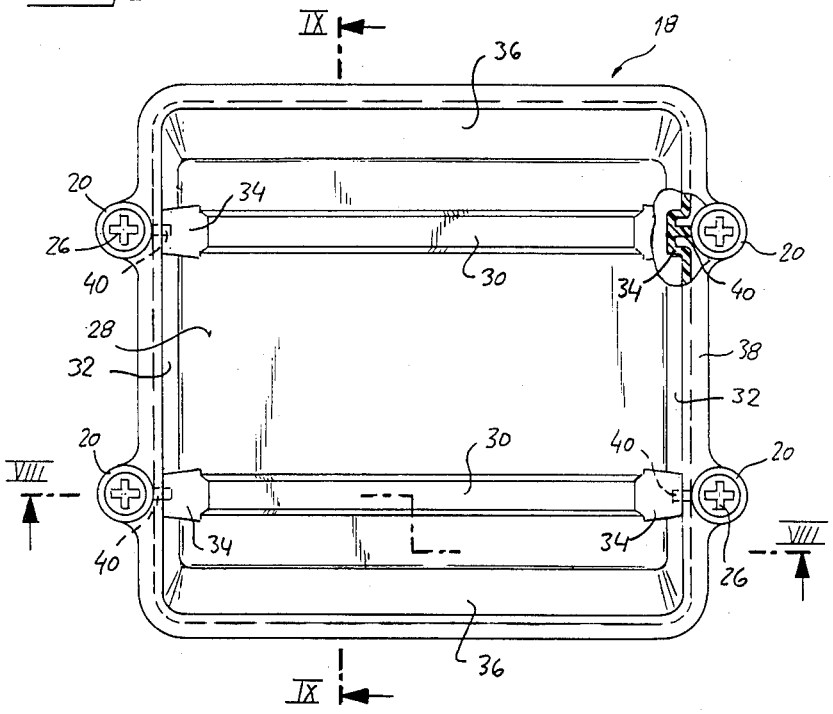
Figure 8:
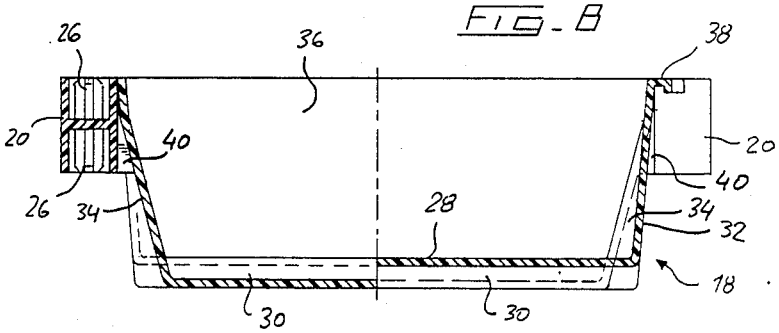
Figure 9:
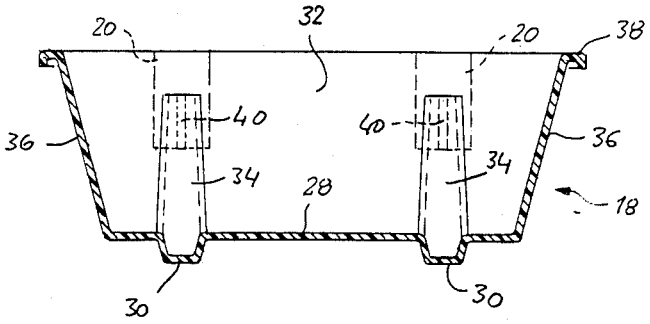
Figure 10:
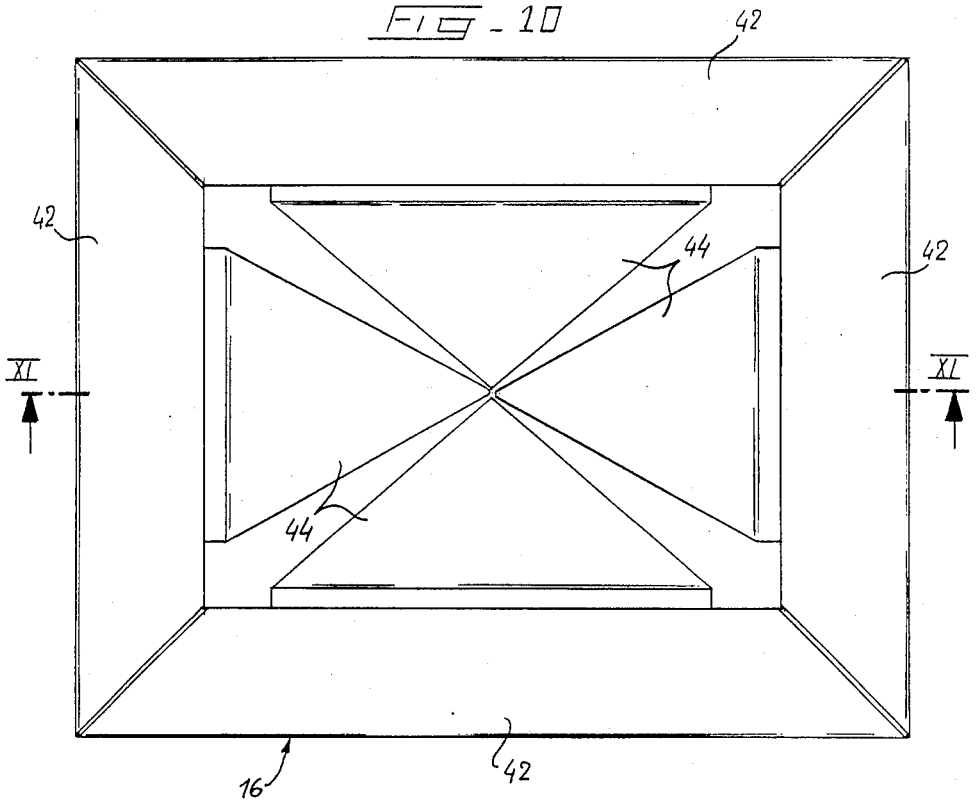
Figure 11:
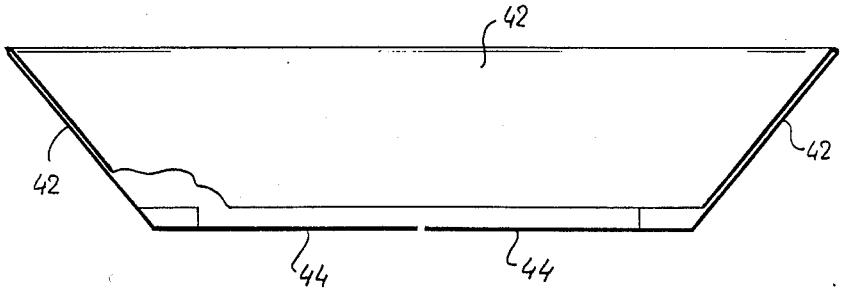
Figure 12:
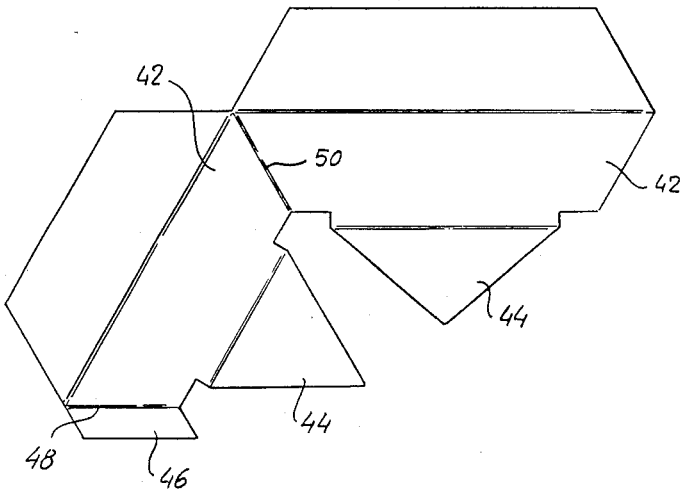
Figure 13:
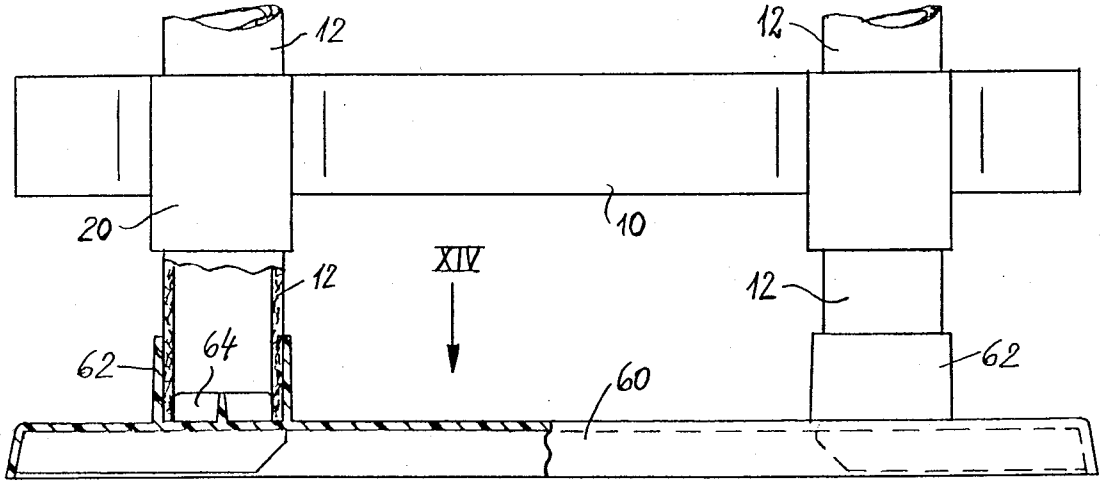
Figure 14:
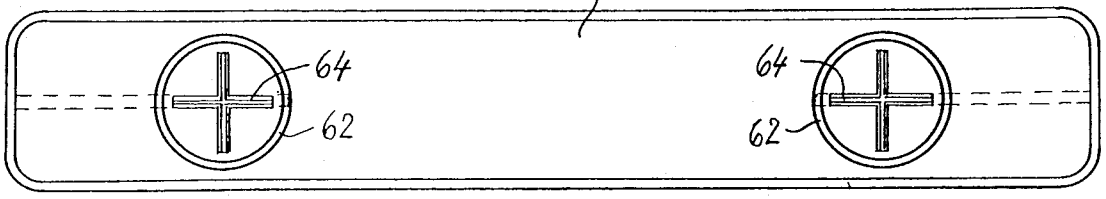

FIG. 1 represents a lateral elevation of a multi-story tower according to the invention in a direction perpendicular to the long side of the right angle of the platforms, FIG. 2 shows a view in the direction of the arrow II in FIG. 1, FIG. 3 shows a plan view of a platform seen from above in the direction of the arrow III in FIG. 1, FIG. 4 shows a view of a platform from beneath in the direction of the arrow IV in FIG. 1, FIG. 5 shows a detail of the connection of spacer supports and a platform, FIG. 6 shows a view in the direction of the arrow VI in FIG. 5, FIG. 7 shows a plan view of a bulk goods trough, FIG. 8 shows a section along the line VIII—VIII in FIG. 7, FIG. 9 shows a section along the line IX—IX in FIG. 7, FIG. 10 shows a plan view of a loose bulk goods attachment for a platform, FIG. 11 shows a section along the line XI—XI in FIG. 10, FIG. 12 shows one of two identical cut-out cardboard shapes for the formation of the bulk goods attachment according to FIGS. 10 and 11, FIG. 13 shows the multi-story tower in lateral elevation with stand foot, partially in section, and FIG. 14 shows a plan view of a stand foot strip in the direction of the arrow XIV in FIG. 13.

According to FIG. 1 the multi-story tower comprises four platforms 10 which are connected with one another by spacer supports 12 in the form of cardboard tubes. A bulk goods attachment 16 stands on one of the platforms 10. Furthermore in place of one platform a special bulk goods trough 18 is interposed between two platforms 10, using the same spacer supports 12. As may be seen from FIG. 1 the spacer supports 12 are spaced from one another by the length of the platform in the direction of the long side of the rectangle of the platform 10.

The rectangularly shaped platform 10 has longer circumferential edges 23 and shorter circumferential edges 25.

FIG. 2 shows that in the direction of the short side of the platform the intervals of the spacer supports 12 from one another are shorter than the short side of the rectangle.

According to FIG. 3 the reception sockets 20 are fitted on the platforms 10 outside the outline of the platform tangentially to the surrounding wall 22, each in the region of the short side of the rectangle. Two outwardly concave interconnection bows 27 extend between the edges 25 and each of the sockets 20. The interconnection bows are substantially tangent to the external circumference of the sockets 20 and to the shorter edges 25. Further, the bows 27 are symmetrical to the associated stiffening rib 24.

FIG. 4 shows that the platforms 10 possess stiffening ribs 24 on their under side which are connected with the reception sockets 20.

FIG. 5 shows that the reception sockets 20 terminate at the top flush with the surrounding wall 22 and protrude downwards beyond the surrounding wall. Each platform has a bottom 21. For the securing of the spacer supports 12 in the reception sockets 20 the latter are formed with a central cruciform support 26.

FIGS. 7, 8 and 9 show the bulk goods trough 18 according to FIGS. 1 and 2. The bulk goods trough has stiffening ribs 30 in the bottom 28. These stiffening ribs 30 continue upwards in the short side walls 32 as lateral stiffening ribs 34. The short side walls 32 and also the long side walls 36 diverge upwards conically from one another. The lateral stiffening ribs 34 are of such configuration that they do not hinder the stacking of bulk goods troughs 18 of like forms. For the same reason the reception sockets 20 extend over only about half the height of the bulk goods troughs. The upper ends of the reception sockets 20 are flush with an upper edge flange 38 of the bulk goods trough. Moreover the reception sockets 20 are connected with the short side walls 32 by junction flanges 40.

In FIGS. 10 and 11 as alternative to the bulk goods trough 18 a bulk goods attachment 16 is illustrated. The bulk goods attachment has upwardly conically diverging side walls 42 and bottom flaps 44 which can be glued to the platform concerned. As may be seen from FIG. 12 each bulk goods attachment 16 is formed from two flat cut-out cardboard shapes. The cardboard shapes are glued with one another by means of a connecting tab 46 in each case. The bulk goods attachment can be laid flat along the edges 48 and 50 to form a flat pack.

As may be seen especially from FIGS. 2, 3, 4 and 8, the reception sockets 20 are arranged symmetrically in relation to the long axis of symmetry.

According to FIGS. 13 and 14 the lowermost platform 10 is connected with stand foot strips 60. Each of these stand foot strips 60 has two reception sockets 62 on the bottom of each of which a cruciform clamp piece 64 is arranged. The reception sockets 62 of the stand foot strips 60 are connected with the reception sockets 20 of the lowermost platform 10 by spacer supports 12, which are formed in conformity with the spacer supports 12 between successive platforms 10. The length of the spacer supports 12 can vary. In one extreme case the spacer supports 12 are so dimensioned that the reception sockets 62 and 20 abut on one another. In the other extreme case the spacer supports can be up to about 350 mm. in length.

I claim:

1. A multi-story tower for goods display, comprising a plurality of carrier elements (10,18) vertically spaced from one another, and a plurality of vertically extending spacer support columns (12) connecting two successive carrier elements (10,18) with one another, said carrier elements (10,18) having a bottom (21,28) and a substantially rectangular circumference when regarded in vertical direction with two mutually opposite first circumferential edges (23) and two mutually opposite second circumferential edges (25), said carrier elements (10,18) further being provided with at least two stiffening ribs (24;30,34) on the respective bottom (21,28), said stiffening ribs (24;30,34) extending parallel with respect to said first edges (23) and being inwardly spaced from respective first edges (23) by equal distances, said stiffening ribs (24;30,34) extending towards said second edges (25), four tubular reception sockets (20) each with a substantially vertical axis and a circular external circumference being provided at said second edges (25), such that respective axes of said sockets (20) are in horizontal alignment with respective longitudinal axes of said stiffening ribs (24;30,34), said sockets (20) being interconnected with said stiffening ribs (24;30,34) at respective ends thereof in substantially vertical planes extending along said stiffening ribs (24;30,34) and containing the axes of respective tubular sockets (20), each said tubular socket (20) being further connected with the respective second edge (25) by two outwardly concave interconnection bows (27), said interconnection bows (27) adjoining substantially tangentially the external circumference of said sockets (20) on the one hand and the respective second edge (25) on the other hand, the interconnection bows (27) of each socket (20) being substantially symmetrical with respect to the respective stiffening rib (24;30,34) when regarded in vertical direction, said tubular sockets (20) receiving respective ends of respective lower and upper spacer support columns (12), said spacer support columns (12) permitting an observation of the respective bottom (21,28) in a direction parallel to said first edges (23) on both diametrically opposed sides of the respective spacer support columns (12).

2. A multi-story tower as set forth in claim 1, said circumferential edges (23,25) being provided with respective vertically extending wall sections (22), said tubular sockets (20) being tangential with the wall sections (22) of the respective second edges (25) and said interconnection bows (27) being tangential with respect to the wall sections (22) of the respective second edge (25).

3. A multi-story tower as set forth in claim 1, said bottom (21) being substantially planar.

4. A multi-story tower as set forth in claim 1, said carrier element (18) being formed as a trough with a bottom (28) and sidewalls (32,36).

5. A multi-story tower as set forth in claim 4, said sidewalls (32,36) being tapered upwardly and outwardly from the respective bottom (28), said stiffening ribs (30,34) extending both over the bottom (28) and the sidewalls (32), said sockets (20) being interconnected with the respective stiffening ribs (30,34) by junction flanges (40).

6. A multi-story tower as set forth in claim 5, said tubular sockets (20) having lower ends upwardly spaced from the bottom (28), such as to allow stacking of a plurality of trough-shaped carrier elements (18).

7. A multi-story tower as set forth in claim 6, said stiffening ribs (30,34) being of tapered hollow formation, such as to permit stacking.

8. A multistory tower as set forth in claim 1, said carrier elements (10,18) being injection molded or cast from synthetic plastics material.

9. A multi-story tower as set forth in claim 1, said spacer support columns (12) being formed by cardboard tubes.

10. A multi-story tower as set forth in claim 1, a lowermost of said carrier elements (10,18) being provided with downwardly extending spacer support columns (12), said downwardly extending spacer support columns (12) being received with lower ends thereof in respective reception sockets (20) of a foot construction.

11. A multi-story tower as set forth in claim 10, said foot construction comprising two mutually parallel stand foot strips (60), each of said stand foot strips (60) being connected with two reception sockets (62).

12. A multi-story tower as set forth in claim 1, at least one of said carrier elements (10) carrying a bulk goods attachment (16) formed from at least one folded cardboard cut-out shape.

* * * * *